US006756995B2

(12) United States Patent
Thebault et al.

(10) Patent No.: US 6,756,995 B2
(45) Date of Patent: Jun. 29, 2004

(54) METHOD AND APPARATUS FOR PROCESSING VIDEO PICTURE DATA FOR DISPLAY ON A DISPLAY DEVICE

(75) Inventors: Cedric Thebault, Sevran (FR); Carlos Correa, Villingen-Schwenningen (DE); Sébastien Weitbruch, Mönchweiler (DE)

(73) Assignee: Thomson Licensing S.A., Boulogne-Billancourt (FR)

( * ) Notice: Subject to any disclaimer, the term of this patent is extended or adjusted under 35 U.S.C. 154(b) by 261 days.

(21) Appl. No.: 10/139,764

(22) Filed: May 6, 2002

(65) Prior Publication Data

US 2002/0190931 A1 Dec. 19, 2002

(30) Foreign Application Priority Data

Jun. 1, 2001 (EP) ..... 01250199

(51) Int. Cl.[7] ..... G09G 5/10

(52) U.S. Cl. ..... 345/690; 345/596; 345/691; 358/3.13

(58) Field of Search ..... 345/690, 63, 89, 345/691, 208, 199, 213, 596–599; 382/237, 251, 252; 358/3.03, 3.06, 3.13

(56) References Cited

U.S. PATENT DOCUMENTS 5,485,558 A * 1/1996 Weise et al. ..... 345/597
6,002,493 A * 12/1999 Case ..... 358/3.06
6,069,609 A 5/2000 Ishida et al.
6,104,377 A * 8/2000 Ledoux ..... 345/596
6,278,437 B1 * 8/2001 Iga et al. ..... 345/598
6,335,989 B1 * 1/2002 Lin ..... 382/260
6,700,559 B1 * 3/2004 Tanaka et al. ..... 345/88

FOREIGN PATENT DOCUMENTS

EP 0994457 4/2000

* cited by examiner

*Primary Examiner*—Kent Chang
(74) *Attorney, Agent, or Firm*—Joseph S. Tripoli; Harvey D. Fried; Sammy S. Henig

(57) ABSTRACT

The invention is related to a new kind of dithering method for plasma display panels. In a former Europena Patent Application a dithering method for the plasma display technology has been presented that utilizes a 3-dimensional dither pattern for the repeated use in a video sequence. A first dimension corresponds to a number of video frames, a second dimension corresponds to a number of video lines, and a third dimension corresponds to a number of cells or pixels in a video line. It has been found that this dither pattern has for some video levels the drawback of a generating a noticeable pattern in homogenous surfaces on the screen that reduces the picture quality. In order to overcome this drawback the invention proposes a new degree of freedom for the dither pattern. Different dither patterns are provided for different entries in a number of least significant bits of the data word representing the input video level. The invention makes it possible to suppress the disturbing patterns occurring on the plasma screen when using the conventional dither patterns.

12 Claims, 8 Drawing Sheets

FRAME 1

| | R | G | B | R | G | B | R | G |
|---|---|---|---|---|---|---|---|---|
| line 1 | 7 | 3 | 6 | 2 | 7 | 3 | 6 | 2 |
| line 2 | 0 | 4 | 1 | 5 | 0 | 4 | 1 | 5 |
| line 3 | 6 | 2 | 7 | 3 | 6 | 2 | 7 | 3 |
| line 4 | 1 | 5 | 0 | 4 | 1 | 5 | 0 | 4 |

FRAME 2

| | R | G | B | R | G | B | R | G |
|---|---|---|---|---|---|---|---|---|
| line 1 | 4 | 0 | 5 | 1 | 4 | 0 | 5 | 1 |
| line 2 | 3 | 7 | 2 | 6 | 3 | 7 | 2 | 6 |
| line 3 | 5 | 1 | 4 | 0 | 5 | 1 | 4 | 0 |
| line 4 | 2 | 6 | 3 | 7 | 2 | 6 | 3 | 7 |

FRAME 3

| | R | G | B | R | G | B | R | G |
|---|---|---|---|---|---|---|---|---|
| line 1 | 2 | 6 | 3 | 7 | 2 | 6 | 3 | 7 |
| line 2 | 5 | 1 | 4 | 0 | 5 | 1 | 4 | 0 |
| line 3 | 3 | 7 | 2 | 6 | 3 | 7 | 2 | 6 |
| line 4 | 4 | 0 | 5 | 1 | 4 | 0 | 5 | 1 |

FRAME 4

| | R | G | B | R | G | B | R | G |
|---|---|---|---|---|---|---|---|---|
| line 1 | 1 | 5 | 0 | 4 | 1 | 5 | 0 | 4 |
| line 2 | 6 | 2 | 7 | 3 | 6 | 2 | 7 | 3 |
| line 3 | 0 | 4 | 1 | 5 | 0 | 4 | 1 | 5 |
| line 4 | 7 | 3 | 6 | 2 | 7 | 3 | 6 | 2 |

Fig. 3

| FRAME 1 | R | G | B | R | G | B | R | G | B | R | G | B |
|---|---|---|---|---|---|---|---|---|---|---|---|---|
| line 1 | 1 | 0 | 0 | 0 | 1 | 0 | 0 | 0 | 1 | 0 | 0 | 0 |
| line 2 | 0 | 0 | 0 | 0 | 0 | 0 | 0 | 0 | 0 | 0 | 0 | 0 |
| line 3 | 0 | 0 | 1 | 0 | 0 | 0 | 1 | 0 | 0 | 0 | 1 | 0 |
| line 4 | 0 | 0 | 0 | 0 | 0 | 0 | 0 | 0 | 0 | 0 | 0 | 0 |

| FRAME 2 | R | G | B | R | G | B | R | G | B | R | G | B |
|---|---|---|---|---|---|---|---|---|---|---|---|---|
| line 1 | 0 | 0 | 0 | 0 | 0 | 0 | 0 | 0 | 0 | 0 | 0 | 0 |
| line 2 | 0 | 1 | 0 | 0 | 0 | 1 | 0 | 0 | 0 | 1 | 0 | 0 |
| line 3 | 0 | 0 | 0 | 0 | 0 | 0 | 0 | 0 | 0 | 0 | 0 | 0 |
| line 4 | 0 | 0 | 0 | 1 | 0 | 0 | 0 | 1 | 0 | 0 | 0 | 1 |

| FRAME 3 | R | G | B | R | G | B | R | G | B | R | G | B |
|---|---|---|---|---|---|---|---|---|---|---|---|---|
| line 1 | 0 | 0 | 0 | 1 | 0 | 0 | 0 | 1 | 0 | 0 | 0 | 1 |
| line 2 | 0 | 0 | 0 | 0 | 0 | 0 | 0 | 0 | 0 | 0 | 0 | 0 |
| line 3 | 0 | 1 | 0 | 0 | 0 | 1 | 0 | 0 | 0 | 1 | 0 | 0 |
| line 4 | 0 | 0 | 0 | 0 | 0 | 0 | 0 | 0 | 0 | 0 | 0 | 0 |

| FRAME 4 | R | G | B | R | G | B | R | G | B | R | G | B |
|---|---|---|---|---|---|---|---|---|---|---|---|---|
| line 1 | 0 | 0 | 0 | 0 | 0 | 0 | 0 | 0 | 0 | 0 | 0 | 0 |
| line 2 | 0 | 0 | 1 | 0 | 0 | 0 | 1 | 0 | 0 | 0 | 1 | 0 |
| line 3 | 0 | 0 | 0 | 0 | 0 | 0 | 0 | 0 | 0 | 0 | 0 | 0 |
| line 4 | 1 | 0 | 0 | 0 | 1 | 0 | 0 | 0 | 1 | 0 | 0 | 0 |

Fig. 4

| | R | | | | G | | | | B | | | |
|---|---|---|---|---|---|---|---|---|---|---|---|---|
| line 1 | 1/4 | 1/4 | 0 | 0 | 0 | 1/4 | 1/4 | 0 | 0 | 0 | 1/4 | 1/4 |
| line 2 | 0 | 0 | 1/4 | 1/4 | 1/4 | 0 | 0 | 1/4 | 1/4 | 1/4 | 0 | 0 |
| line 3 | 0 | 0 | 1/4 | 1/4 | 1/4 | 0 | 0 | 1/4 | 1/4 | 1/4 | 0 | 0 |
| line 4 | 1/4 | 1/4 | 0 | 0 | 0 | 1/4 | 1/4 | 0 | 0 | 0 | 1/4 | 1/4 |

Fig. 5

| | | Level 0 | | | | Level 1/8 | | | | Level 1/4 | | | | Level 3/8 | | | |
|---|---|---|---|---|---|---|---|---|---|---|---|---|---|---|---|---|---|
| Cell-Based Dithering (1 mask) | line 1 | 0 | 0 | 0 | 0 | 1/4 | 1/4 | 0 | 0 | 1/4 | 1/4 | 1/4 | 1/4 | 1/4 | 1/2 | 1/2 | 1/4 |
| | line 2 | 0 | 0 | 0 | 0 | 0 | 0 | 1/4 | 1/4 | 1/4 | 1/4 | 1/4 | 1/4 | 1/2 | 1/4 | 1/4 | 1/2 |
| | line 3 | 0 | 0 | 0 | 0 | 0 | 0 | 1/4 | 1/4 | 1/4 | 1/4 | 1/4 | 1/4 | 1/2 | 1/4 | 1/4 | 1/2 |
| | line 4 | 0 | 0 | 0 | 0 | 1/4 | 1/4 | 0 | 0 | 1/4 | 1/4 | 1/4 | 1/4 | 1/4 | 1/2 | 1/2 | 1/4 |

| | | Level 1/2 | | | | Level 5/8 | | | | Level 3/4 | | | | Level 7/8 | | | |
|---|---|---|---|---|---|---|---|---|---|---|---|---|---|---|---|---|---|
| Cell-Based Dithering (1 mask) | line 1 | 1/2 | 1/2 | 1/2 | 1/2 | 1/2 | 3/4 | 3/4 | 1/2 | 3/4 | 3/4 | 3/4 | 3/4 | 1 | 3/4 | 3/4 | 1 |
| | line 2 | 1/2 | 1/2 | 1/2 | 1/2 | 3/4 | 1/2 | 1/2 | 3/4 | 3/4 | 3/4 | 3/4 | 3/4 | 3/4 | 1 | 1 | 3/4 |
| | line 3 | 1/2 | 1/2 | 1/2 | 1/2 | 3/4 | 1/2 | 1/2 | 3/4 | 3/4 | 3/4 | 3/4 | 3/4 | 3/4 | 1 | 1 | 3/4 |
| | line 4 | 1/2 | 1/2 | 1/2 | 1/2 | 1/2 | 3/4 | 3/4 | 1/2 | 3/4 | 3/4 | 3/4 | 3/4 | 1 | 3/4 | 3/4 | 1 |

Fig. 6

| | | Level 0 | | | | Level 1/8 | | | | Level 1/4 | | | | Level 3/8 | | | |
|---|---|---|---|---|---|---|---|---|---|---|---|---|---|---|---|---|---|
| Multi-Mask Dithering | line 1 | 0 | 0 | 0 | 0 | 1/4 | 0 | 1/4 | 0 | 1/4 | 1/4 | 1/4 | 1/4 | 1/2 | 1/4 | 1/2 | 1/4 |
| | line 2 | 0 | 0 | 0 | 0 | 0 | 1/4 | 0 | 1/4 | 1/4 | 1/4 | 1/4 | 1/4 | 1/4 | 1/2 | 1/4 | 1/2 |
| | line 3 | 0 | 0 | 0 | 0 | 1/4 | 0 | 1/4 | 0 | 1/4 | 1/4 | 1/4 | 1/4 | 1/2 | 1/4 | 1/2 | 1/4 |
| | line 4 | 0 | 0 | 0 | 0 | 0 | 1/4 | 0 | 1/4 | 1/4 | 1/4 | 1/4 | 1/4 | 1/4 | 1/2 | 1/4 | 1/2 |

| | | Level 1/2 | | | | Level 5/8 | | | | Level 3/4 | | | | Level 7/8 | | | |
|---|---|---|---|---|---|---|---|---|---|---|---|---|---|---|---|---|---|
| Multi-Mask Dithering | line 1 | 1/2 | 1/2 | 1/2 | 1/2 | 1/2 | 3/4 | 1/2 | 3/4 | 3/4 | 3/4 | 3/4 | 3/4 | 1 | 3/4 | 1 | 3/4 |
| | line 2 | 1/2 | 1/2 | 1/2 | 1/2 | 3/4 | 1/2 | 3/4 | 1/2 | 3/4 | 3/4 | 3/4 | 3/4 | 3/4 | 1 | 3/4 | 1 |
| | line 3 | 1/2 | 1/2 | 1/2 | 1/2 | 1/2 | 3/4 | 1/2 | 3/4 | 3/4 | 3/4 | 3/4 | 3/4 | 1 | 3/4 | 1 | 3/4 |
| | line 4 | 1/2 | 1/2 | 1/2 | 1/2 | 3/4 | 1/2 | 3/4 | 1/2 | 3/4 | 3/4 | 3/4 | 3/4 | 3/4 | 1 | 3/4 | 1 |

Fig. 9

| | | Frame 1 | | | | Frame 2 | | | | Frame 3 | | | | Frame 4 | | | |
|---|---|---|---|---|---|---|---|---|---|---|---|---|---|---|---|---|---|
| | | R | G | B | R | G | B | R | G | B | R | G | B | R | G | B | R |
| Level 1/8 | line 1 | 1 | 0 | 0 | 0 | 0 | 0 | 1 | 0 | 0 | 0 | 0 | 0 | 0 | 0 | 0 | 0 |
| | line 2 | 0 | 0 | 0 | 0 | 0 | 0 | 0 | 0 | 0 | 1 | 0 | 0 | 0 | 0 | 0 | 1 |
| | line 3 | 0 | 0 | 1 | 0 | 1 | 0 | 0 | 0 | 0 | 0 | 0 | 0 | 0 | 0 | 0 | 0 |
| | line 4 | 0 | 0 | 0 | 0 | 0 | 0 | 0 | 0 | 0 | 0 | 0 | 1 | 0 | 1 | 0 | 0 |
| Level 1/4 | line 1 | 1 | 0 | 0 | 0 | 0 | 0 | 1 | 0 | 0 | 0 | 0 | 1 | 0 | 1 | 0 | 0 |
| | line 2 | 0 | 1 | 0 | 0 | 0 | 0 | 0 | 1 | 0 | 0 | 1 | 0 | 1 | 0 | 0 | 0 |
| | line 3 | 0 | 0 | 1 | 0 | 1 | 0 | 0 | 0 | 0 | 1 | 0 | 0 | 0 | 0 | 0 | 1 |
| | line 4 | 0 | 0 | 0 | 1 | 0 | 1 | 0 | 0 | 1 | 0 | 0 | 0 | 0 | 0 | 1 | 0 |
| Level 3/8 | line 1 | 1 | 0 | 0 | 0 | 0 | 0 | 1 | 0 | 1 | 0 | 0 | 1 | 0 | 1 | 1 | 0 |
| | line 2 | 0 | 1 | 1 | 0 | 1 | 0 | 0 | 1 | 0 | 1 | 0 | 0 | 0 | 0 | 0 | 1 |
| | line 3 | 0 | 0 | 1 | 0 | 1 | 0 | 0 | 0 | 0 | 1 | 1 | 0 | 1 | 0 | 0 | 1 |
| | line 4 | 1 | 0 | 0 | 1 | 0 | 1 | 1 | 0 | 0 | 0 | 0 | 1 | 0 | 1 | 0 | 0 |
| Level 1/2 | line 1 | 1 | 0 | 1 | 0 | 0 | 1 | 0 | 1 | 1 | 0 | 1 | 0 | 0 | 1 | 0 | 1 |
| | line 2 | 0 | 1 | 0 | 1 | 1 | 0 | 1 | 0 | 0 | 1 | 0 | 1 | 1 | 0 | 1 | 0 |
| | line 3 | 1 | 0 | 1 | 0 | 0 | 1 | 0 | 1 | 1 | 0 | 1 | 0 | 0 | 1 | 0 | 1 |
| | line 4 | 0 | 1 | 0 | 1 | 1 | 0 | 1 | 0 | 0 | 1 | 0 | 1 | 1 | 0 | 1 | 0 |
| Level 5/8 | line 1 | 1 | 1 | 0 | 1 | 0 | 1 | 1 | 1 | 1 | 0 | 0 | 1 | 0 | 1 | 1 | 0 |
| | line 2 | 0 | 1 | 1 | 0 | 1 | 0 | 0 | 1 | 1 | 1 | 1 | 0 | 1 | 0 | 1 | 1 |
| | line 3 | 0 | 1 | 1 | 1 | 1 | 1 | 0 | 1 | 0 | 1 | 1 | 0 | 1 | 0 | 0 | 1 |
| | line 4 | 1 | 0 | 0 | 1 | 0 | 1 | 1 | 0 | 1 | 0 | 1 | 1 | 1 | 1 | 1 | 0 |
| Level 3/4 | line 1 | 1 | 0 | 1 | 1 | 0 | 1 | 1 | 1 | 1 | 1 | 0 | 1 | 1 | 1 | 1 | 0 |
| | line 2 | 0 | 1 | 1 | 1 | 1 | 0 | 1 | 1 | 1 | 1 | 1 | 0 | 1 | 1 | 0 | 1 |
| | line 3 | 1 | 1 | 1 | 0 | 1 | 1 | 0 | 1 | 0 | 1 | 1 | 1 | 1 | 0 | 1 | 1 |
| | line 4 | 1 | 1 | 0 | 1 | 1 | 1 | 1 | 0 | 1 | 0 | 1 | 1 | 0 | 1 | 1 | 1 |
| Level 7/8 | line 1 | 1 | 0 | 1 | 1 | 1 | 1 | 1 | 1 | 1 | 1 | 1 | 0 | 1 | 1 | 1 | 1 |
| | line 2 | 1 | 1 | 1 | 1 | 0 | 1 | 1 | 1 | 1 | 1 | 1 | 1 | 1 | 1 | 0 | 1 |
| | line 3 | 1 | 1 | 1 | 0 | 1 | 1 | 1 | 1 | 1 | 0 | 1 | 1 | 1 | 1 | 1 | 1 |
| | line 4 | 1 | 1 | 1 | 1 | 1 | 1 | 0 | 1 | 1 | 1 | 1 | 1 | 0 | 1 | 1 | 1 |

Fig. 7

| | | R | | | | G | | | | B | | | |
|---|---|---|---|---|---|---|---|---|---|---|---|---|---|
| Level 1/8 | line 1 | 1 | 0 | 0 | 0 | 0 | 1 | 0 | 0 | 0 | 0 | 1 | 0 |
| | line 2 | 0 | 0 | 0 | 0 | 0 | 0 | 0 | 0 | 0 | 0 | 0 | 0 |
| | line 3 | 0 | 0 | 1 | 0 | 0 | 0 | 0 | 1 | 1 | 0 | 0 | 0 |
| | line 4 | 0 | 0 | 0 | 0 | 0 | 0 | 0 | 0 | 0 | 0 | 0 | 0 |
| Level 1/4 | line 1 | 1 | 0 | 0 | 0 | 0 | 1 | 0 | 0 | 0 | 0 | 1 | 0 |
| | line 2 | 0 | 0 | 0 | 1 | 1 | 0 | 0 | 0 | 0 | 1 | 0 | 0 |
| | line 3 | 0 | 0 | 1 | 0 | 0 | 0 | 0 | 1 | 1 | 0 | 0 | 0 |
| | line 4 | 0 | 1 | 0 | 0 | 0 | 0 | 1 | 0 | 0 | 0 | 0 | 1 |
| Level 3/8 | line 1 | 1 | 0 | 0 | 0 | 0 | 1 | 0 | 0 | 0 | 0 | 1 | 0 |
| | line 2 | 0 | 0 | 1 | 1 | 1 | 0 | 0 | 1 | 1 | 1 | 0 | 0 |
| | line 3 | 0 | 0 | 1 | 0 | 0 | 0 | 0 | 1 | 1 | 0 | 0 | 0 |
| | line 4 | 1 | 1 | 0 | 0 | 0 | 1 | 1 | 0 | 0 | 0 | 1 | 1 |
| Level 1/2 | line 1 | 1 | 0 | 1 | 0 | 0 | 1 | 0 | 1 | 1 | 0 | 1 | 0 |
| | line 2 | 0 | 1 | 0 | 1 | 1 | 0 | 1 | 0 | 0 | 1 | 0 | 1 |
| | line 3 | 1 | 0 | 1 | 0 | 0 | 1 | 0 | 1 | 1 | 0 | 1 | 0 |
| | line 4 | 0 | 1 | 0 | 1 | 1 | 0 | 1 | 0 | 0 | 1 | 0 | 1 |
| Level 5/8 | line 1 | 1 | 1 | 0 | 1 | 1 | 1 | 1 | 0 | 0 | 1 | 1 | 1 |
| | line 2 | 0 | 0 | 1 | 1 | 1 | 0 | 0 | 1 | 1 | 1 | 0 | 0 |
| | line 3 | 0 | 1 | 1 | 1 | 1 | 0 | 1 | 1 | 1 | 1 | 0 | 1 |
| | line 4 | 1 | 1 | 0 | 0 | 0 | 1 | 1 | 0 | 0 | 0 | 1 | 1 |
| Level 3/4 | line 1 | 1 | 1 | 1 | 0 | 0 | 1 | 1 | 1 | 1 | 0 | 1 | 1 |
| | line 2 | 0 | 1 | 1 | 1 | 1 | 0 | 1 | 1 | 1 | 1 | 0 | 1 |
| | line 3 | 1 | 0 | 1 | 1 | 1 | 1 | 0 | 1 | 1 | 1 | 1 | 0 |
| | line 4 | 1 | 1 | 0 | 1 | 1 | 1 | 1 | 0 | 0 | 1 | 1 | 1 |
| Level 7/8 | line 1 | 1 | 1 | 1 | 0 | 0 | 1 | 1 | 1 | 1 | 0 | 1 | 1 |
| | line 2 | 1 | 1 | 1 | 1 | 1 | 1 | 1 | 1 | 1 | 1 | 1 | 1 |
| | line 3 | 1 | 0 | 1 | 1 | 1 | 1 | 0 | 1 | 1 | 1 | 1 | 0 |
| | line 4 | 1 | 1 | 1 | 1 | 1 | 1 | 1 | 1 | 1 | 1 | 1 | 1 |

Fig. 8

METHOD AND APPARATUS FOR PROCESSING VIDEO PICTURE DATA FOR DISPLAY ON A DISPLAY DEVICE

BACKGROUND OF THE INVENTION

The invention relates to a method and apparatus for processing video picture data for display on a display device. More specifically the invention is closely related to a kind of video processing for improving the picture quality of pictures which are displayed on matrix displays like plasma display panels (PDP) or other display devices where the pixel values control the generation of a corresponding number of small lighting pulses on the display.

The Plasma technology now makes it possible to achieve flat colour panel of large size (out of the CRT limitations) and with very limited depth without any viewing angle constraints.

Referring to the last generation of European TV, a lot of work has been made to improve its picture quality. Consequently, a new technology like the Plasma one has to provide a picture quality as good or better than standard TV technology. On one hand, the Plasma technology gives the possibility of "unlimited" screen size, of attractive thickness . . . but on the other hand, it generates new kinds of artefacts which could degrade the picture quality.

Most of these artefacts are different as for CRT TV pictures and that makes them more visible since people are used to see the old TV artefacts unconsciously.

A Plasma Display Panel (PDP) utilizes a matrix array of discharge cells which could only be "ON" or "OFF". Also unlike a CRT or LCD in which grey levels are expressed by analogue control of the light emission, a PDP controls the grey level by modulating the number of light pulses per frame (sustain pulses). This time-modulation will be integrated by the eye over a period corresponding to the eye time response.

Since the video amplitude determines the number of light pulses, occurring at a given frequency, more amplitude means more light pulses and thus more "ON" time. For this reason, this kind of modulation is also known as PWM, pulse width modulation.

This PWM is responsible for one of the PDP image quality problems: the poor grey scale portrayal quality, especially in the darker regions of the picture. This is due to the fact, that the displayed luminance is linear to the number of pulses, but the eye response and its sensitivity to noise is not linear. In darker areas the eye is more sensitive than in brighter areas. This means that even though modern PDPs can display e.g. 255 discrete video levels for each colour component R,G,B, the quantisation error will be quite noticeable in the darker areas. Further on, the required degamma operation in PDP displays, increases quantisation noise in video dark areas, resulting in a perceptible lack of resolution.

There are known some solutions which use a dithering method for reducing the perceptibility of quantisation noise in PDP'S.

From a former European Patent Application of the applicant having the number 00250099.9 it is known to use a 3-dimensional static dither patterns for the cells of a plasma display panel to improve the grey scale rendition. The three dimensions corresponding to a number of frames, a number of lines and a number of columns on the PDP. With this pattern for some video levels some checked patterns could be seen in homogenous surfaces that reduce the picture quality.

From EP-A-0 994 457 it is known to store a set of dither patterns in memory and to select the right dither pattern in dependence on time data (field data) and positional data indicating the locations of the pixels on the display panel. In another embodiment different dither patterns are used independence on what video level an input data word represents. The different video level ranges are e.g. defined to be 0 . . . 15, 16 . . . 31, 32 . . . 47, and 48 . . . 63.

From U.S. Pat. No. 6,069,609 it is known to store in memory a number of different dither patterns called 'dither types'. These dither patterns are selected with the 5 higher bits of an 8 bit input data word and the three lower bits determine which of the eight dither values from the dither type needs to be taken for dithering.

SUMMARY OF THE INVENTION

To overcome the drawback of reduced picture quality when using a static 3-dimensional dither pattern, the present invention, reports a dithering technique that makes use of different dither patterns for different entries in a number of least significant bits of the data word representing the input video level. In case that the dither patterns itself are also 3-dimensional, the invention utilizes quasi a 4-dimensional dither pattern with the fourth dimension being the entries in a number of least significant bits of an input video level data word. The invention makes it possible to suppress the disturbing patterns occurring on the plasma screen when using the 3-dimensional dither pattern.

Further advantageous embodiments are apparent from the dependent claims.

The input data words need to be transformed in a form where they have more bits than necessary for the final bit resolution that is required in the subsequent sub-field coding process. The bit resolution needs to be increased corresponding to the bit resolution for the dithering process.

This transformation can advantageously be done in a degamma calculation step in which the input video levels are amplified in order to compensate for the gamma correction in the video source.

In cases where the set of admissible input video levels is restricted, for the purpose of optimising the sub-field coding process by taking only those video levels to which sub-field code words are assigned that are less sensitive to the dynamic false contouring, the transformation can also be done in a resealing step where the data words for the reduced set of video levels are translated into data words having less bits.

For an apparatus for processing video pictures according to the invention it is advantageous when the dither unit comprises a table of different dither patterns for different entries in a number of least significant bits of the data word representing the input video level and a selector that assigns to a given video level one of the dither patterns stored in the table. This is a simple implementation of the invention.

Further advantageous is if for each colour component R, G, B of the input video signal a dedicated table of dither patterns is provided in the dither unit. This allows to use a single clock signal, e.g. pixel clock for dither number retrieval in the dithering process.

BRIEF DESCRIPTION OF THE DRAWINGS

Exemplary embodiments of the invention are illustrated in the drawings and are explained in more detail in the following description.

FIG. 3 shows a 3-dimensional cell-based static dither pattern;

FIG. 4 illustrates the effect that patterns occur on a screen when each colour component has a fixed low video level and the dithering technique with use of a static dither pattern is used;

FIG. 5 shows the result of temporal integration of the patterns shown in FIG. 4;

FIG. 6 shows the result of temporal integration of the patterns shown in FIG. 3 for different input video levels for one colour component;

FIG. 7 shows the different 3-dimensional cell-based dither patterns according to the invention for different input video levels;

FIG. 8 shows the 3-dimensional cell-based dither patterns according to the invention in modified form for different input video levels but only for one frame;

FIG. 9 illustrates the resulting patterns that occur on a screen when the dithering technique with use of the dither patterns as shown in FIG. 7 or 8 is used;

DESCRIPTION OF THE PREFERRED EMBODIMENTS

Figure 1:
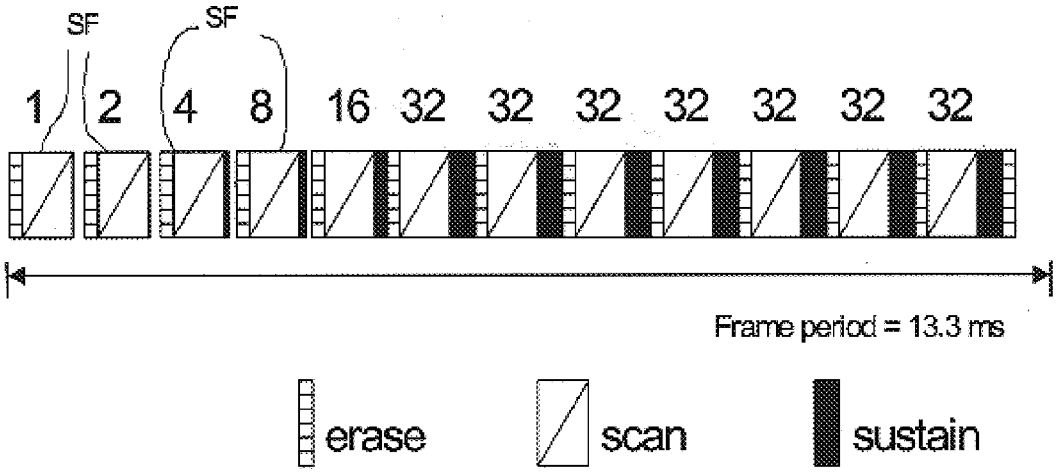
FIG. 1 shows an illustration for the plasma cell activation with small pulses in sub-fields.

In FIG. 1, the general concept of light generation in plasma display panels is illustrated. As mentioned before, a plasma cell can only be switched on or off. Therefore, the light generation is being done in small pulses where a plasma cell is switched on. The different colours are produced by modulating the number of small pulses per frame period. To do this a frame period is subdivided in so called sub-fields SF. Each sub-field SF has assigned a specific weight which determines how many light pulse are produced in this sub-field SF. Light generation is controlled by sub-field code words. A sub-field code word is a binary number which controls sub-field activation and inactivation. Each bit being set to 1 activates the corresponding sub-field SF. Each bit being set to 0 inactivates the corresponding sub-field SF. In an activated sub-field SF the assigned number of light pulses will be generated. In an inactivated sub-field there will be no light generation. A typical sub-field organisation with 12 sub-fields SF is shown in FIG. 1. The sub-field weights are listed at the top of the figure.

The frame period is illustrated slightly longer than all the sub-field periods together. This has the reason that for non-standard video sources the video line may be subject of jittering and to make sure that all sub-fields SF fit into the jittering video line, the total amount of time for all sub-fields SF is slightly shorter than a standard video line.

For clarification, a definition of the term sub-field is given here: A sub-field is a period of time in which successively the following is being done with a cell:

1. There is a writing/addressing period in which the cell is either brought to an excited state with a high voltage or with lower voltage to a neutral state.
2. There is a sustain period in which a gas discharge is made with short voltage pulses which lead to corresponding short lighting pulses. Of course only the cells previously excited will produce lighting pulses. There will not be a gas discharge in the cells in neutral state.
3. There is an erasing period in which the charge of the cells is quenched.

In some specific plasma driving schemes (NFC coding) the addressing or erasing periods are not present in each sub-field. Instead, a selective addressing/erasing is performed ahead or after a group of sub-fields.

As mentioned before, plasma uses PWM (pulse width modulation) to generate the different shades of grey. Contrarily to CRTs where luminance is approximately quadratic to the applied cathode voltage, luminance is linear to the number of discharge pulses in PDPs. Therefore, an approximately quadratic gamma function has to be applied to the input video signal components R,G,B before the PWM.

The effect of this gamma function on the input video data is shown in the following table, where a quadratic gamma function is applied (calculated with 16-bit resolution). After applying the quadratic degamma function to the input video data, in the next column the effect of this degamma function is depicted. The numbers in this column were achieved after dividing the quadratic numbers in the previous column by 256 and truncation. By doing this it is assured that the output video range and the input video range is identical.

| 8 Bit Input Video Data (X) | 16 Bit Degamma Data (X**2) | 8 Bit Output Video Data (X**2/255) | 11 Bit Degamma Data (X**2)/32 | 8 Bit Input Video Data (X) | 16 Bit Degamma Data (X**2) | 8 Bit Output Video Data (X**2/255) | 11 Bit Degamma Data (X**2)/32 |
|---|---|---|---|---|---|---|---|
| 0 | 0 | 0 | 0 | 128 | 16384 | 64 | 512 |
| 1 | 1 | 0 | 0 | 129 | 16641 | 65 | 520 |
| 2 | 4 | 0 | 0 | 130 | 16900 | 66 | 528 |
| 3 | 9 | 0 | 0 | 131 | 17161 | 67 | 536 |
| 4 | 16 | 0 | 0 | 132 | 17424 | 68 | 544 |
| 5 | 25 | 0 | 0 | 133 | 17689 | 69 | 552 |
| 6 | 36 | 0 | 1 | 134 | 17956 | 70 | 561 |
| 7 | 49 | 0 | 1 | 135 | 18225 | 71 | 569 |
| 8 | 64 | 0 | 2 | 136 | 18496 | 72 | 578 |
| 9 | 81 | 0 | 2 | 137 | 18769 | 73 | 586 |
| 10 | 100 | 0 | 3 | 138 | 19044 | 74 | 595 |
| 11 | 121 | 0 | 3 | 139 | 19321 | 75 | 603 |
| 12 | 144 | 0 | 4 | 140 | 19600 | 76 | 612 |
| 13 | 169 | 0 | 5 | 141 | 19881 | 77 | 621 |
| 14 | 196 | 0 | 6 | 142 | 20164 | 79 | 630 |
| 15 | 225 | 0 | 7 | 143 | 20449 | 80 | 639 |

-continued

| 8 Bit Input Video Data (X) | 16 Bit De-gamma Data (X**2) | 8 Bit Output Video Data (X**2/255) | 11 Bit Degamma Data (X**2)/32 | 8 Bit Input Video Data (X) | 16 Bit De-gamma Data (X**2) | 8 Bit Out-put Video Data (X**2/255) | 11 Bit De-gamma Data (X**2)/32 |
|---|---|---|---|---|---|---|---|
| 16 | 256 | 1 | 8 | 144 | 20736 | 81 | 648 |
| 17 | 289 | 1 | 9 | 145 | 21025 | 82 | 657 |
| 18 | 324 | 1 | 10 | 146 | 21316 | 83 | 666 |
| 19 | 361 | 1 | 11 | 147 | 21609 | 84 | 675 |
| 20 | 400 | 1 | 12 | 148 | 21904 | 85 | 684 |
| 21 | 441 | 1 | 13 | 149 | 22201 | 87 | 693 |
| 22 | 484 | 1 | 15 | 150 | 22500 | 88 | 703 |
| 23 | 529 | 2 | 16 | 151 | 22801 | 89 | 712 |
| 24 | 576 | 2 | 18 | 152 | 23104 | 90 | 722 |
| 25 | 625 | 2 | 19 | 153 | 23409 | 91 | 731 |
| 26 | 676 | 2 | 21 | 154 | 23716 | 93 | 741 |
| 27 | 729 | 2 | 22 | 155 | 24025 | 94 | 750 |
| 28 | 768 | 3 | 24 | 156 | 24336 | 95 | 760 |
| 29 | 841 | 3 | 26 | 157 | 24649 | 96 | 770 |
| 30 | 900 | 3 | 28 | 158 | 24964 | 97 | 780 |
| 31 | 961 | 3 | 30 | 159 | 25281 | 99 | 790 |
| 32 | 1024 | 4 | 32 | 160 | 25600 | 100 | 800 |
| 33 | 1089 | 4 | 34 | 161 | 25921 | 101 | 810 |
| 34 | 1156 | 4 | 36 | 162 | 26244 | 102 | 820 |
| 35 | 1225 | 4 | 38 | 163 | 26569 | 104 | 830 |
| 36 | 1296 | 5 | 40 | 164 | 26896 | 105 | 840 |
| 37 | 1369 | 5 | 42 | 165 | 27225 | 106 | 850 |
| 38 | 1444 | 5 | 45 | 166 | 27556 | 108 | 861 |
| 39 | 1521 | 5 | 47 | 167 | 27889 | 109 | 871 |
| 40 | 1600 | 6 | 50 | 168 | 28224 | 110 | 882 |
| 41 | 1681 | 6 | 52 | 169 | 28561 | 112 | 892 |
| 42 | 1764 | 6 | 55 | 170 | 28900 | 113 | 903 |
| 43 | 1849 | 7 | 57 | 171 | 29241 | 114 | 913 |
| 44 | 1936 | 7 | 60 | 172 | 29584 | 116 | 924 |
| 45 | 2025 | 7 | 63 | 173 | 29929 | 117 | 935 |
| 46 | 2116 | 8 | 66 | 174 | 30276 | 118 | 946 |
| 47 | 2209 | 8 | 69 | 175 | 30625 | 120 | 957 |
| 48 | 2304 | 9 | 72 | 176 | 30976 | 121 | 968 |
| 49 | 2401 | 9 | 75 | 177 | 31329 | 122 | 979 |
| 50 | 2500 | 9 | 78 | 178 | 31684 | 124 | 990 |
| 51 | 2601 | 10 | 81 | 179 | 32041 | 125 | 1001 |
| 52 | 2704 | 10 | 84 | 180 | 32400 | 127 | 1012 |
| 53 | 2809 | 11 | 87 | 181 | 32761 | 128 | 1023 |
| 54 | 2916 | 11 | 91 | 182 | 33124 | 129 | 1035 |
| 55 | 3025 | 11 | 94 | 183 | 33489 | 131 | 1046 |
| 56 | 3136 | 12 | 98 | 184 | 33856 | 132 | 1058 |
| 57 | 3249 | 12 | 101 | 185 | 34225 | 134 | 1069 |
| 58 | 3364 | 13 | 105 | 186 | 34596 | 135 | 1081 |
| 59 | 3481 | 13 | 108 | 187 | 34969 | 137 | 1092 |
| 60 | 3600 | 14 | 112 | 188 | 35344 | 138 | 1104 |
| 61 | 3721 | 14 | 116 | 189 | 35721 | 140 | 1116 |
| 62 | 3844 | 15 | 120 | 190 | 36100 | 141 | 1128 |
| 63 | 3969 | 15 | 124 | 191 | 36481 | 143 | 1140 |
| 64 | 4096 | 16 | 128 | 192 | 36864 | 144 | 1152 |
| 65 | 4225 | 16 | 132 | 193 | 37249 | 146 | 1164 |
| 66 | 4356 | 17 | 136 | 194 | 37636 | 147 | 1176 |
| 67 | 4489 | 17 | 140 | 195 | 38025 | 149 | 1188 |
| 68 | 4624 | 18 | 144 | 196 | 38416 | 150 | 1200 |
| 69 | 4761 | 18 | 148 | 197 | 38809 | 152 | 1212 |
| 70 | 4900 | 19 | 153 | 198 | 39204 | 153 | 1225 |
| 71 | 5041 | 19 | 157 | 199 | 39601 | 155 | 1237 |
| 72 | 5184 | 20 | 162 | 200 | 40000 | 156 | 1250 |
| 73 | 5329 | 20 | 166 | 201 | 40401 | 158 | 1262 |
| 74 | 5476 | 21 | 171 | 202 | 40804 | 160 | 1275 |
| 75 | 5625 | 22 | 175 | 203 | 41209 | 161 | 1287 |
| 76 | 5776 | 22 | 180 | 204 | 41616 | 163 | 1300 |
| 77 | 5929 | 23 | 185 | 205 | 42025 | 164 | 1313 |
| 78 | 6084 | 23 | 190 | 206 | 42436 | 166 | 1326 |
| 79 | 6241 | 24 | 195 | 207 | 42849 | 168 | 1339 |
| 80 | 6400 | 25 | 200 | 208 | 43264 | 169 | 1352 |
| 81 | 6561 | 25 | 205 | 209 | 43681 | 171 | 1365 |
| 82 | 6724 | 26 | 210 | 210 | 44100 | 172 | 1378 |
| 83 | 6889 | 27 | 215 | 211 | 44512 | 174 | 1391 |
| 84 | 7056 | 27 | 220 | 212 | 44944 | 176 | 1404 |
| 85 | 7225 | 28 | 225 | 213 | 45369 | 177 | 1417 |
| 86 | 7396 | 29 | 231 | 214 | 45796 | 179 | 1431 |
| 87 | 7569 | 29 | 236 | 215 | 46225 | 181 | 1444 |
| 88 | 7744 | 30 | 242 | 216 | 46656 | 182 | 1458 |
| 89 | 7921 | 31 | 247 | 217 | 47089 | 184 | 1471 |

-continued

| 8 Bit Input Video Data (X) | 16 Bit De-gamma Data (X**2) | 8 Bit Output Video Data (X**2/255) | 11 Bit Degamma Data (X**2)/32 | 8 Bit Input Video Data (X) | 16 Bit De-gamma Data (X**2) | 8 Bit Out-put Video Data (X**2/255) | 11 Bit De-gamma Data (X**2)/32 |
|---|---|---|---|---|---|---|---|
| 90 | 8100 | 31 | 253 | 218 | 47524 | 186 | 1485 |
| 91 | 8281 | 32 | 258 | 219 | 47961 | 188 | 1498 |
| 92 | 8464 | 33 | 264 | 220 | 48400 | 189 | 1512 |
| 93 | 8649 | 33 | 270 | 221 | 48841 | 191 | 1526 |
| 94 | 8836 | 34 | 276 | 222 | 49284 | 193 | 1540 |
| 95 | 9025 | 35 | 282 | 223 | 49729 | 195 | 1554 |
| 96 | 9216 | 36 | 288 | 224 | 50176 | 196 | 1568 |
| 97 | 9409 | 36 | 294 | 225 | 50625 | 198 | 1582 |
| 98 | 9604 | 37 | 300 | 226 | 51076 | 200 | 1596 |
| 99 | 9801 | 38 | 306 | 227 | 51529 | 202 | 1610 |
| 100 | 10000 | 39 | 312 | 228 | 51984 | 203 | 1624 |
| 101 | 10201 | 40 | 318 | 229 | 52441 | 205 | 1638 |
| 102 | 10404 | 40 | 325 | 230 | 52900 | 207 | 1653 |
| 103 | 10609 | 41 | 331 | 231 | 53361 | 209 | 1667 |
| 104 | 10816 | 42 | 338 | 232 | 53824 | 211 | 1682 |
| 105 | 11025 | 43 | 344 | 233 | 54289 | 212 | 1696 |
| 106 | 11236 | 44 | 351 | 234 | 54756 | 214 | 1711 |
| 107 | 11449 | 44 | 357 | 235 | 55225 | 216 | 1725 |
| 108 | 11664 | 45 | 364 | 236 | 55696 | 218 | 1740 |
| 109 | 11881 | 46 | 371 | 237 | 56169 | 220 | 1755 |
| 110 | 12100 | 47 | 378 | 238 | 56644 | 222 | 1770 |
| 111 | 12321 | 48 | 385 | 239 | 57121 | 224 | 1785 |
| 112 | 12544 | 49 | 392 | 240 | 57600 | 225 | 1800 |
| 113 | 12769 | 50 | 399 | 241 | 58081 | 227 | 1815 |
| 114 | 12996 | 50 | 406 | 242 | 58564 | 229 | 1830 |
| 115 | 13225 | 51 | 413 | 243 | 59049 | 231 | 1845 |
| 116 | 13456 | 52 | 420 | 244 | 59536 | 233 | 1860 |
| 117 | 13689 | 53 | 427 | 245 | 60025 | 235 | 1875 |
| 118 | 13924 | 54 | 435 | 246 | 60516 | 237 | 1891 |
| 119 | 14161 | 55 | 442 | 247 | 61009 | 239 | 1906 |
| 120 | 14400 | 56 | 450 | 248 | 61504 | 241 | 1922 |
| 121 | 14641 | 57 | 457 | 249 | 62001 | 243 | 1937 |
| 122 | 14884 | 58 | 465 | 250 | 62500 | 245 | 1953 |
| 123 | 15129 | 59 | 472 | 251 | 63001 | 247 | 1968 |
| 124 | 15376 | 60 | 480 | 252 | 63504 | 249 | 1984 |
| 125 | 15625 | 61 | 488 | 253 | 64009 | 251 | 2000 |
| 126 | 15876 | 62 | 496 | 254 | 64516 | 253 | 2016 |
| 127 | 16129 | 63 | 504 | 255 | 65025 | 255 | 2032 |

As it can be seen from the values in the columns headed 8 bit output video data, for smaller input values, many input levels are mapped to the same output level. This is due to division by 255 and truncation. In other words, for darker areas, the quantisation step is higher than for the higher areas which corresponds to non-linear quantisation. In particular the values smaller than 16 are all mapped to 0 (this corresponds to four bit video data resolution which is unacceptable for video signal processing).

Dithering is a known technique for avoiding to lose amplitude resolution bits due to truncation. This technique only works if the required resolution is available before the truncation step. But this is the case in the present application, because the video data after degamma operation has 16 bit resolution and in the corresponding columns there are no two identical values. Dithering can in principle bring back as many bits as those lost by truncation. However, the dithering noise frequency decreases, and therefore becomes more noticeable, with the number of dither bits.

1 bit-dithering corresponds to multiply the number of available output levels by 2, 2 bit-dithering corresponds to multiply the number of available output levels by 4 and 3 bit-dithering corresponds to multiply the number of available output levels by 8.

Looking at the table above, in particular to the input values less than 16 reveals that at minimum 3 bit-dithering is required to reproduce the 256 video levels more correctly with the required grey scale portrayal of a 'CRT' display device.

In the table above the columns headed 11 Bit Degamma Data contain the output data from the degamma unit. These values are derived from the values in the columns headed 16 Bit Degamma data by dividing them by 32 or better by truncation of 5 bits. How these values are used in the dithering process will be explained later on.

Next, the cell-based dithering will be explained in detail.

Figure 2:
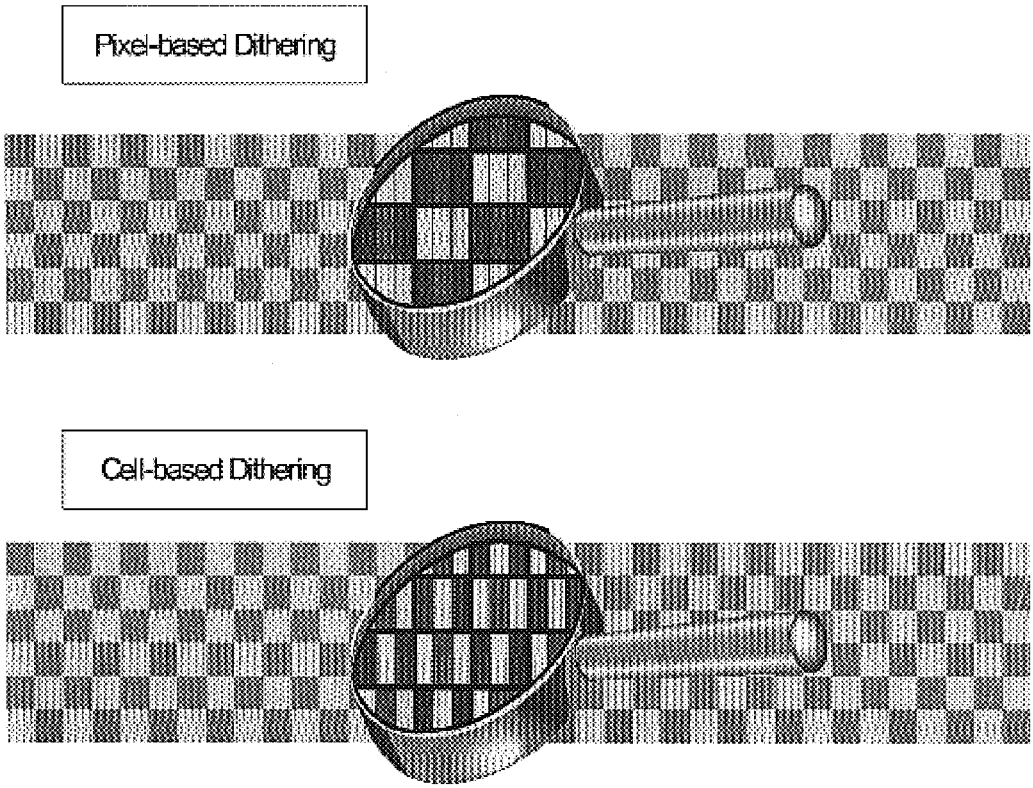
FIG. 2 shows an illustration for pixel-based and cell-based dithering.

With cell-based dithering as illustrated in FIG. 2 a dither number is added to every panel cell in contrast to every panel pixel as usually done. A panel pixel is composed of three cells: red, green and blue cell aligned in a video line for each pixel. The cell-based dithering has the advantage of rendering the dithering noise finer and thus making it less noticeable to the human viewer.

Because the dither pattern is defined cell-wise, it is not possible to use techniques like error-diffusion, in order to avoid colouring of the picture when one cell would diffuse in the contiguous cell of a different colour. This is not a big disadvantage, because it has been observed sometimes an undesirable low frequency moving interference, between the diffusion of the truncation error and a moving pattern belonging to the video signal. Error diffusion works best in case of static pictures.

Instead of using error diffusion, a new degree of freedom is added to the dither patterns. Starting from a 3 dimensional dither pattern, this leads to a 4-dimensional dither pattern. Before explaining the 4-dimensional dither patterns, it is advantageous to first understand the concept of a 3-dimensional dither pattern which has already been disclosed in a previous European Patent Application of the Applicant having the number 00250099.9. It is expressively referred to this document also for the disclosure of the new invention.

FIG. 3 shows one example for a 3-dimensional dither pattern. 3-bit-dithering is used in this example. This means that the dither numbers have values from 0 to 7. The static 3-dimensional dither pattern is defined for a cube of 4*4*4 cells (4-lines with 4 cells each, repeatedly taken from 4 frames).

The use of a 3 bit-dithering requires that the degamma operation is performed with 3 bits more than final resolution. The final resolution is supposed to be 8 bit resolution. The sub-field coding range is therefore from 0 to 255. Then the output range of the degamma operation should be from 0 to 2040. It is noted that the maximum dither number with 3 bit dithering is 7. If this number is added to 2040, the result is 2047 which is the highest possible 11 bit binary number %11111111111. A slightly lower value than 2040. e.g. 2032 could also be used. This has the advantage that the corresponding values can simply be derived from the 16 bit degamma data by truncating the 5 least significant bits.

Some other examples derived from the table above: if sub-field coding range would be from 0 to 175, output range of degamma operation should be from 0 to 1400; and finally if coding range is from 0 to 127, output range should be from 0 to 1016. For every panel cell and for every frame, the corresponding dither pattern value is added to the output of the degamma function, and consequently truncated to the final number of bits.

The final bit resolution does not need to be necessarily 8 bit resolution. In another European Patent Application of the applicant having the application number 01250158.1 an example is explained where the final bit resolution is 6 bits only due to a decimation of the set of input video levels in order to avoid dynamic false contouring. In this case 9 bit data words need to be provided by the degamma and rescaling unit, thus corresponding to truncation of 7 bits from the 16 bit degamma data words. If the video range is from 0 to 36, then the output range of the degamma operation in 9 bit resolution should be from 0 to 10.

The 3-bit dither pattern shown in FIG. 3 is static. This means that it is repeatedly used for the whole panel. From FIG. 3 it can be seen that the dither pattern is repeated in horizontal direction of the panel. However, it also repeats in vertical direction and in time direction accordingly.

It is noted that the proposed pattern, when integrated over time, always gives the same value for all panel cells. If this were not the case, under some circumstances, some cells could acquire an amplitude offset compared to other cells which would correspond to an undesirable fixed spurious static pattern.

A problem of the 3-dimensional dither patterns is that mainly in static pictures having homogenous surfaces for some video levels some noticeable patterns can occur. This problematic can be seen for example for a video level of ⅛ after degamma operation, to be displayed with 3 bits of dithering. In this case, when the previous dithering is applied, the pattern shown in FIG. 4 will appear on the PDP. The temporal integration of this pattern over the 4 frames gives for each color a checked pattern with 2×2 squares. This is illustrated in FIG. 5. This is a static pattern that also occurs in the following 4 frame periods as the pixels which have '0' in the FIG. 5 are always 'off', while the others are 'on' once in four frames. This pattern is quite noticeable in big monochrome areas and also in an area having a dominant colour component.

In FIG. 6 the temporal integration of the dither patterns are shown for the video levels 0, ⅛, ¼, . . . ⅞. The displayed patterns are patterns for one colour component, namely R. It is pointed out that the disturbing patterns will not only occur for these 8 lowest video levels but also for the video levels 1, 1⅛, 1¼, 1⅜, and so on. Of course, as the human eye is more sensitive to relative luminance/chrominance differences, the most disturbing patterns are in the low video level range (dark scenes).

This noisy static pattern could be reduced to a checked pattern twice smaller by the use of a modified 3-dimensional dither pattern, but in this case, the previous pattern will appear for another video level.

Another idea to suppress this pattern could be to use a dithering based on 8 frames, but in this case the temporal frequency of the dithering will be too low, and so the problem of flickering will appear.

In fact, it is not possible with only one 3-dimensional dither pattern to suppress all the noisy static patterns for all the dither values. It is therefore an idea of the invention to use more 3-dimensional dither patterns. This is equivalent with the concept of a 4-dimensional dither pattern which will be explained next.

FIG. 7 shows an example of eight different dither patterns for the different video levels after degamma X, X⅛, X¼, X⅜, X½, X⅝, X¾, X⅞ where X stands for any number 0 . . . 255. Only the trivial dither pattern for the level X where all entries are Zero is not shown. The depicted pattern is valid for the colour component R. The dither patterns shown in FIG. 7 could be written in the form of FIG. 3, too. From the aspect of hardware or software expenditure for the implementation it is better to memorize the dither patterns in the form of FIG. 7, because here, for each cell only one single bit needs to be stored in memory. The evaluation of the entries in a dither pattern is performed in such a manner that in each case where a "1" entry is given the binary value %111 will be added to the input value and in each case where a "0" entry is given either no value is added or a Zero value is added. It need not be added a value less than seven in this case because for these values after truncation of the three least significant bits there will not remain an effect on the higher bits. In the illustration of FIG. 7 the truncation effect is already considered.

The 4-dimensional dither pattern is defined in case of 3-bit dithering for a cube of 8*4*4*4 cells (8-level ranges, 4-plasma cells, 4-lines, 4-frames). It should be noted that other alternatives of 4-dimensional dither patterns can be found. Other cubes can be defined and the patterns could also be differently defined.

A problem is to find easily the right entries for a pixel because in each frame the order is R,G,B,R. This problem can be solved by making simply a wrap around each time the four entries for a line have been read out. Then the next entry follows in the first entry of the same line and so on. However, as the processing for the colour components is done quasi in parallel, there is the problem of rightly incrementing the index counter for the table. The counter needs to be incremented three times for each colour component of a pixel and the dithering units for each colour components have to access the same memory having stored the dither pattern. The memory needs to be very fast because there cannot be much delay between the accesses of the dithering units to the memory in order to assure quasi parallelism.

An alternative implementation is to memorize separately a table for each colour component per frame and per video level. In this case with a simple modulo-4 counter the right entry will be easily found for each pixel. The counters can be incremented in parallel and that is easy to implement with a clock signal. For the dither patterns of each colour component a separate memory can be used. This avoids problems with multiple access to a single memory. FIG. 8 shows the dither patterns for the different video levels and for the colour components R, G, B but only for the first frame. The dither patterns for the remaining frames are not shown, but they can be easily derived from FIG. 7. Both alternatives of dither patterns can be regarded as equivalent because they generate the same patterns on the screen.

The dither patterns of FIGS. 7 and 8 have been chosen in order to reduce the size of the noisy static patterns, line flicker, and also the noise introduced by asymmetries between the different dither patterns.

FIG. 9 shows the temporal integration of these dither patterns like in FIG. 6. It is evident from this figure, that the size of noisy static patterns is really reduced. Instead of a checked pattern with 2*2 pixel blocks a checked pattern with 1*1 pixel blocks is generated. Of course, the checked pattern with 1*1 pixel blocks is less noticeable than the checked pattern with 2*2 pixel blocks and so with dither patterns according to the invention, the picture quality is really improved.

Figure 10:
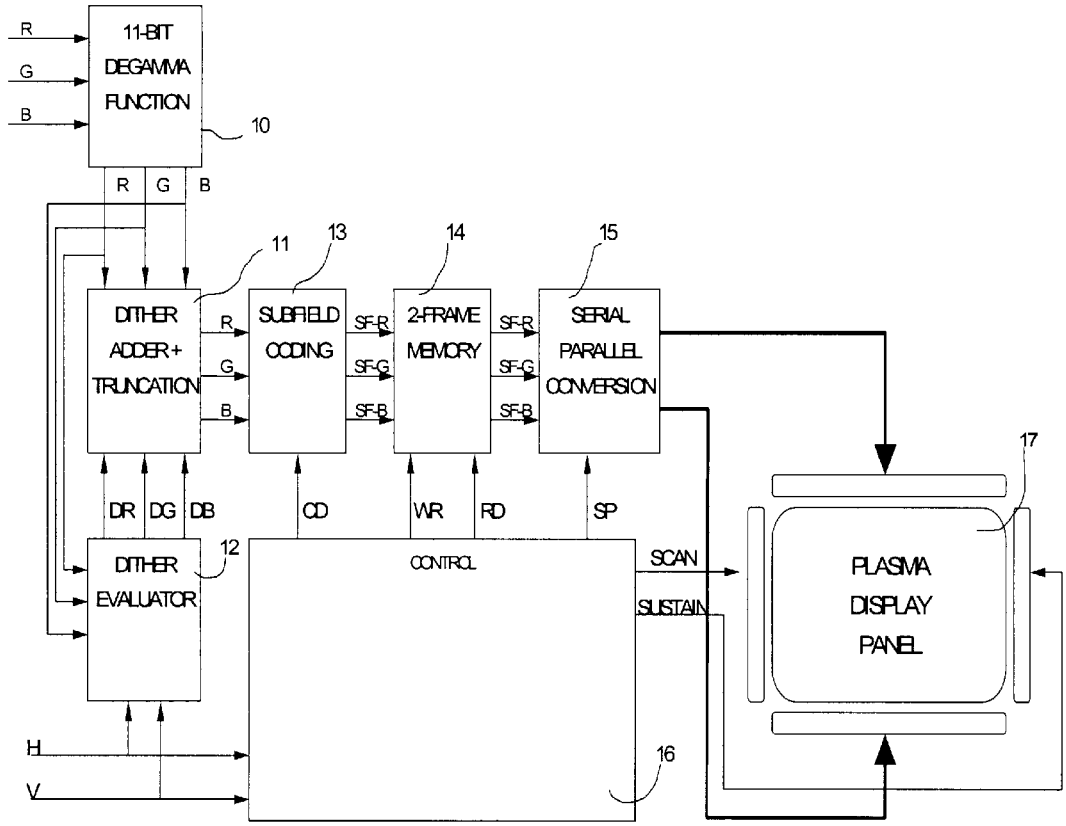
FIG. 10 shows a block diagram of a circuit implementation of the invention in a PDP.

In FIG. 10 a circuit implementation of the invention is illustrated. Input R,G,B video data is forwarded to degamma unit 10. The degamma unit 10 performs the 11-bit degamma function and delivers 11 bit video data RGB at the output. The dither evaluation unit 12 computes the dither numbers: DR for red, DG for green and DB for blue based on the degamma data coming from degamma unit 10. To do that it requires the sync signals H and V to determine which pixel is currently processed and which line and frame number is valid. These information is used for addressing a lookup table in which the dither pattern is stored. The R, G and B components are used in this unit for evaluating the video level range of each component. In calculation unit 11 the resulting dither numbers and the degamma output values are added and the 3 least significant bits of the resulting data words are truncated so that the final output values R, G and B are achieved. These values are forwarded to a sub-field coding unit 13 which performs sub-field coding under control of control unit 16. The sub-field code words are stored in memory unit 14. Reading and writing from and to this memory unit is also controlled by the external control unit 16. For plasma display panel addressing, the sub-field code words are read out of the memory device and all the code words for one line are collected in order to create a single very long code word which can be used for the line-wise PDP addressing. This is carried out in the serial to parallel conversion unit 15. The control unit 16 generates all scan and sustain pulses for PDP control. It receives horizontal and vertical synchronising signals for reference timing.

Figure 11:
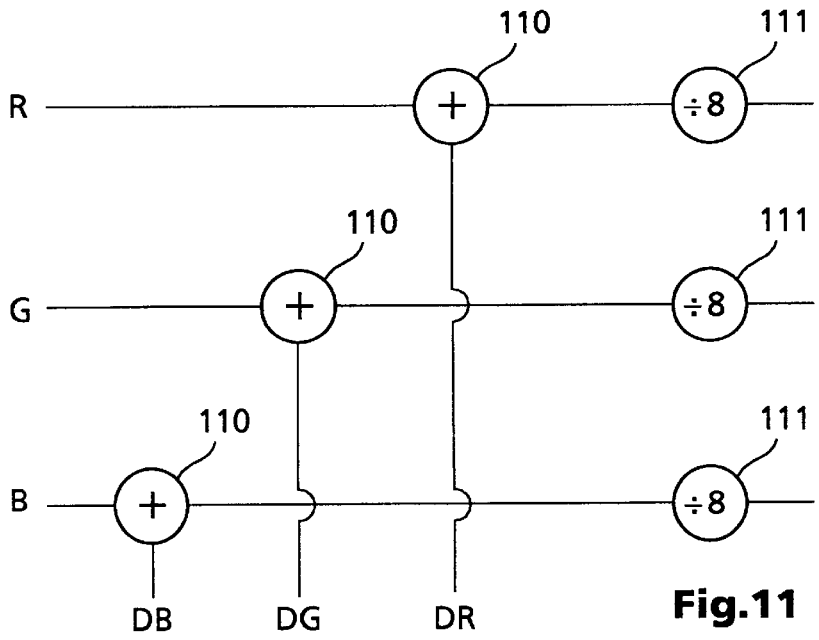
FIG. 11 shows a block diagram of a dithering unit.

In FIG. 11 the components of the calculation unit 11 are shown. Reference number 110 denotes the adder that adds the dither value DR, DG, DB to the the 11 bit degamma data R, G, B. Reference number 111 denotes the truncation stage in which the three least significant bits of the resulting 11 bit data words are truncated. Finally the resulting 8 bit data words are output and they will be used for sub-field coding in sub-field coding unit 13.

Figure 12:
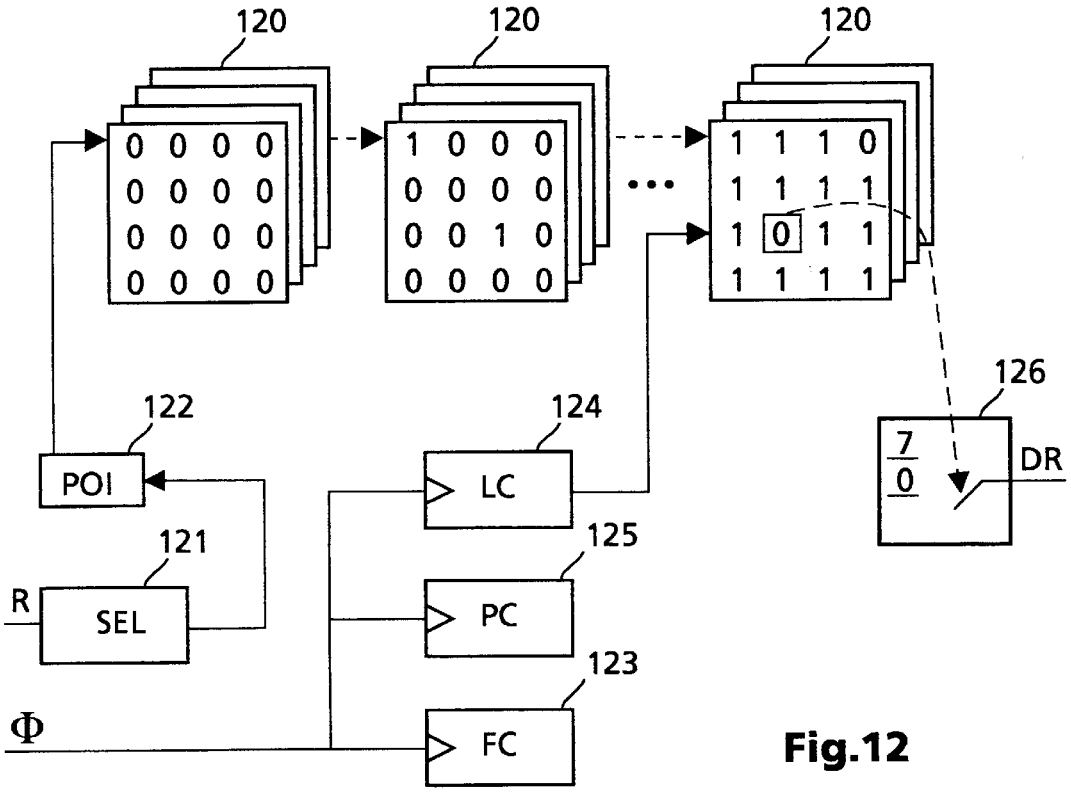
FIG. 12 shows a block diagram of a dithering evaluation unit.

FIG. 12 shows in more detail the structure of the dither evaluation unit 12. With reference number 120 the tables with the dither patterns are denoted. In order to be able to store the complete 4-dimensional dither pattern the memory range is subdivided in 8 sectors having each the dither patterns for one of the different eight possible input values corresponding to the entries in the three least significant bits of the input value. For the addressing of the memory the following components are provided. First, the input value is fed to a selector 121. The three least significant bits determine which value is required in pointer 122. This pointer points to the beginning of a memory sector. Furthermore, a set of three modulo-4-counters 123 to 125 is provided. One is a frame counter 123, one is a line counter 124 and one is a pixel counter 125. The frame conuter 123 determines which of the 4*4 tables for the 4 successive frames needs to be taken. The line counter 124 determines the line within the 4*4 table and the pixel counter 125 determines the position within the selected line. All the three modulo-4-counters are clocked by the same clock signal Φ that corresponds to the pixel clock in the PDP signal processing. The right address for memory addressing is determined by multiplying the entry in the frame counter by 16, multiplying the entry in the line counter by 4, and adding the resulting values plus the entry in the position counter to the pointer value of pointer 122. The entry in the resulting address is read out and determines which dither value DR is output by the dithering evaluation unit 12. For this purpose a second selector 126 is provided. The dither value 7 is output if the read out value is equal to "1" and the value 0 is output if the read out value is equal to "0". The components depicted in FIG. 12 while shown only for the colour component R are also required for the other color components G and B.

The invention can be used in particular in PDPs. Plasma displays are currently used in consumer electronics, e.g. for TV sets, and also as a monitor for computers. However, use of the invention is also appropriate for matrix displays where the light emission/generation is also controlled with small pulses in sub-fields, i.e. where the PWM principle is used for controlling brightness.

It is noted that the disclosed embodiment is an example and that the number of dither bits as well as the size and type of dither pattern can be subject of modification in other embodiments of the invention.

What is claimed:

1. Method for processing video picture data for display on a display device having for each pixel a number of luminous elements hereinafter called cells corresponding to the colour components of a pixel, wherein a dithering method is applied to the video data to refine the grey-scale portrayal in the video pictures, in which dither values derived from a dither pattern are added to data words representing the input video levels, characterized in that, for different input video levels different dither patterns are used, wherein the entries in a number of least significant bits of the data word representing the input video level determine which of the dither patterns is to be used for the dithering process.

2. Method according to claim 1, wherein a cell-based dithering is used and the dither patterns are 3-dimensional dither patterns, wherein a first dimension corresponds to a number of video frames, a second dimension corresponds to a number of video lines, and a third dimension corresponds to a number of cells or pixels in a video line.

3. Method according to claim 1, wherein the data words for the input video levels are transformed in data words having as much more bits than necessary for the final bit resolution as dither bits shall be used for the dithering method before they are input to the dithering process.

4. Method according to claim 1, wherein the dithering method includes the step of truncation of the additional bits after the dither bits had been added to the transformed data word.

5. Method according to claim 3, wherein the transformation of the data words is done in a degamma calculation step in which the input video levels are amplified in order to compensate for the gamma correction in the video source.

6. Method according to claim 3, wherein the transformation of the data words is done in a resealing step in which the input video levels are linearity translated into data words having as much more bits than necessary for the final bit resolution as dither bits shall be used for the dithering method.

7. Method according to claim 6, wherein the rescaling step is based on a decimation of the set of admissible input video levels so that the final bit resolution is lowered.

8. Use of the method according to claim 1, for the video signal processing in a plasma display device.

9. Apparatus for processing video pictures for display on a display device having a plurality of luminous elements corresponding to the colour components of pixels of a video picture, said apparatus comprising a dither unit that calculates dither numbers which are added to video picture data in an adder, thereafter a number of least significant bits of the resulting data word is truncated in a truncation stage, characterized in that, the dither unit comprises a table of different dither patterns for different entries in a number of least significant bits of the data word representing the input video level and a selector that assigns to a given video level one of the dither patterns stored in the table according to the entries in the least significant bits of the data word representing the input video level.

10. Apparatus according to claim 9, wherein the dither patterns in the table are 3-dimensional dither patterns with a first dimension corresponding to a number of video frames, a second dimension corresponding to a number of video lines, and a third dimension corresponding to a number of cells in a video line or a number of pixels in a video line, and the table is addressed by means of a frame counter, a line counter, a cell/pixel counter and a pointer that is set by the selector.

11. Apparatus according to claim 9, wherein the entries for the dither patterns in the table are 1-bit numbers and the apparatus comprises a further selector that outputs the maximum possible dither number according to the specified bit resolution for the dither numbers if a "1"-entry has been read out of the table or that outputs a value less than the maximum possible dither number if a "0"-entry has been read out of the table.

12. Apparatus according to claim 9, wherein for each colour component a particular table of dither patterns is provided in the dither unit.

* * * * *